US008322916B2

(12) United States Patent
Patt

(10) Patent No.: US 8,322,916 B2
(45) Date of Patent: Dec. 4, 2012

(54) THERMAL EXPANSION COMPENSATOR FOR LIQUID-FILLED WATCHES

(76) Inventor: Jeremy James Patt, Midland, MI (US)

( * ) Notice: Subject to any disclaimer, the term of this patent is extended or adjusted under 35 U.S.C. 154(b) by 217 days.

(21) Appl. No.: 12/928,609

(22) Filed: Dec. 15, 2010

(65) Prior Publication Data

US 2012/0155230 A1 Jun. 21, 2012

(51) Int. Cl.
*G04B 37/00* (2006.01)

(52) U.S. Cl. ..... 368/281; 368/291

(58) Field of Classification Search ..... 368/88, 368/281, 286, 291
See application file for complete search history.

(56) References Cited

U.S. PATENT DOCUMENTS

| | | | | |
|---|---|---|---|---|
| 2,656,674 | A * | 10/1953 | Bondy | 368/291 |
| 3,792,578 | A * | 2/1974 | Hetzel | 368/220 |
| 3,811,401 | A * | 5/1974 | Piquerez | 116/270 |
| 3,928,218 | A * | 12/1975 | Rowe et al. | 508/208 |
| 4,080,781 | A | 3/1978 | Klingenberg | |
| 4,459,039 | A | 7/1984 | Klingenberg | |
| 4,479,724 | A * | 10/1984 | Matsumoto et al. | 368/291 |
| 6,219,304 | B1 * | 4/2001 | Mignot et al. | 368/88 |

FOREIGN PATENT DOCUMENTS

| | | |
|---|---|---|
| DE | 19647439 | 5/1998 |
| FR | 2752959 | 3/1998 |
| WO | WO-96/35978 | 11/1996 |
| WO | WO-03/083586 | 10/2003 |

* cited by examiner

*Primary Examiner* — Vit W Miska

(57) ABSTRACT

A watch comprises a case, an electronic movement module inside the case, a piece of closed-cell foam inside the case, and a dielectric liquid filling the remaining voids of the interior of the case. The closed-cell foam compensates for thermal expansion of the dielectric liquid over a wide range of operating temperatures. Upon heating, the liquid expands and the foam is compressed. Upon cooling, the liquid contracts and the foam is decompressed.

6 Claims, 2 Drawing Sheets

THERMAL EXPANSION COMPENSATOR FOR LIQUID-FILLED WATCHES

BACKGROUND

It is well known in the art that a watch case enclosing an electronic movement can be filled with a clear dielectric liquid, typically a silicone oil or a perfluorinated fluid. The dielectric liquid improves water resistance of the watch, prevents condensation of water inside the case, ensures continuous lubrication of the movement, and enhances readability of the dial by reducing undesirable refractions of light.

One challenge in designing a liquid-filled watch is compensating for differential thermal expansion. The thermal expansion coefficients of the known dielectric liquids are significantly larger than those of the known materials used in construction of watch cases, including steels, ceramics, and plastics. Since liquids are incompressible, their expansion inside a confined volume can exert tremendous pressure that is adequate to rupture or displace a watch's crystal. Several methods are known in the art for accommodating thermal expansion in a liquid-filled watch, thereby enabling a wide range of operating temperatures.

For example, U.S. Pat. No. 4,080,781 discloses a watch filled with a liquid and a device for accommodating thermal expansion. In one embodiment, the case is designed with a movable piston in the side wall. The piston extends and retracts to follow changes in the internal liquid volume. In a second embodiment, there is an elastically deformable diaphragm built into a wall of the case. The diaphragm allows the liquid to expand and contract. Both embodiments add substantial mechanical complexity to the case design, resulting in additional costs of manufacturing.

U.S. Pat. No. 4,459,039 discloses a watch filled with a liquid that has one internal enclosure with a deformable wall. The internal enclosure is filled with a gas, and compensates for thermal expansion of the liquid. Three embodiments are disclosed for the internal enclosure: a diaphragm sealed to the interior of the case that contains a fixed quantity of gas; a gas-filled bladder made entirely of flexible material; and a rigid tube having one closed end and a movable flexible plug that holds a fixed quantity of gas inside the tube. A disadvantage of a single interior enclosure is that a leak in the flexible material will allow all the gas to escape from the enclosure and form a large bubble in the liquid. Another disadvantage is the complexity and cost of fabricating the internal gas-filled enclosure.

International Patent Publication No. WO 96/35978 discloses a watch filled with a dielectric fluid in which there is a gas bubble serving to compensate for the differential coefficients of thermal expansion between the liquid and case. One disadvantage is that the gas bubble can be seen floating freely under the crystal. The bubble can be aesthetically objectionable to some users. Another disadvantage is that the procedure for injecting the liquid requires tight control in order to target a specific size of the gas bubble.

German Patent Publication No. DE 19647439 discloses a watch filled with a liquid where the case is designed with a movable piston in the case back. The piston extends and retracts to follow changes in the internal liquid volume. By locating the piston in the case back instead of the side wall of the case, there is room for a piston of significantly larger diameter. The larger diameter bore serves to reduce the travel distance of the piston as it responds to changes in liquid volume. The piston feature adds design complexity and manufacturing cost.

French Patent Publication No. FR 2752959 discloses a watch filled with a liquid where the base of the case is provided with a deformable membrane that is protected by a rigid external wall. In one embodiment, the membrane is constructed of thin stainless steel with circular corrugations to allow for expansion. Small openings in the rigid external wall allow pressure equalization between the membrane and the exterior environment. In addition to the complexity and high manufacturing cost of this design, the space between the membrane and the rigid external wall fills with water when the watch is immersed. After exiting the water, the residual water in the space gradually drains onto the wrist of the user.

International Patent Publication No. WO 03/083586 discloses a watch filled with a liquid where the base of the case at least partly comprises an elastic membrane, and an adjacent rigid element to limit deformation of the membrane toward the case interior. The membrane flexes in order to accommodate thermal expansion of the liquid. The membrane feature adds complexity to the case design, resulting in a higher cost of manufacturing.

The invention described herein seeks to provide an improved thermal expansion compensator for liquid-filled watches.

SUMMARY

In accordance with one embodiment a watch comprises: (a) a case; (b) an electronic movement module inside the case; (c) one or more pieces of closed-cell foam inside the case; and (d) a dielectric liquid filling the remaining voids of the interior of the case. The closed-cell foam compensates for thermal expansion of the dielectric liquid by compression to a smaller volume. The use of closed-cell foam allows for simple case construction and low manufacturing cost. The foam can be easily cut into various shapes that conform to interior spaces of the case. Also, closed-cell foam is more robust than a gas-filled bladder, a diaphragm, or a piston since the foam does not rely on a single sealing element for proper function. An additional advantage is that closed-cell foam can be used to quickly retrofit a watch for liquid filling even if the watch was not originally designed to contain liquid.

Further details and advantages will become apparent from the discussion which follows.

BRIEF DESCRIPTION OF DRAWINGS

The invention is described in detail below with reference to the drawings wherein like numerals designate similar parts. In the Figures.

DETAILED DESCRIPTION

Figure 1:
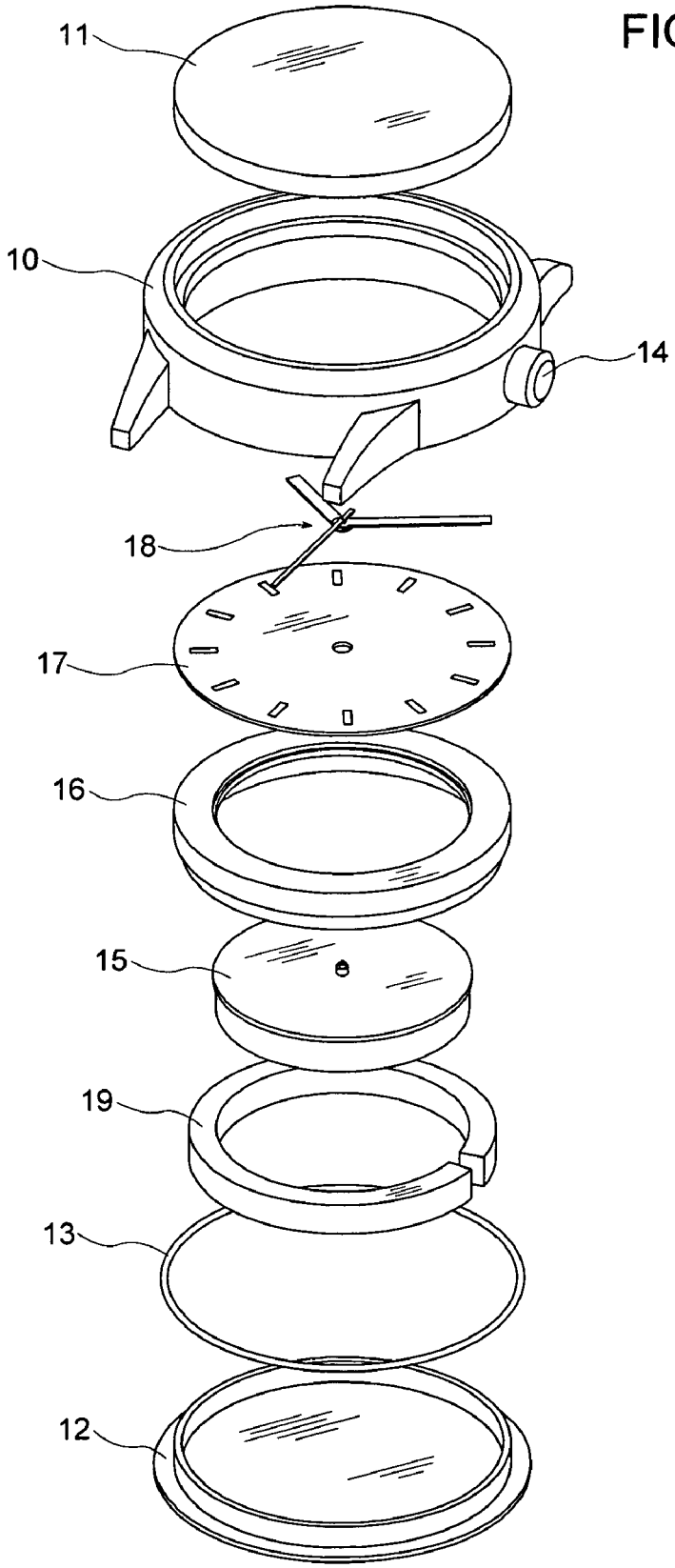
FIG. 1 is an exploded view of a watch with closed-cell foam prior to filling with dielectric liquid.
Figure 2:
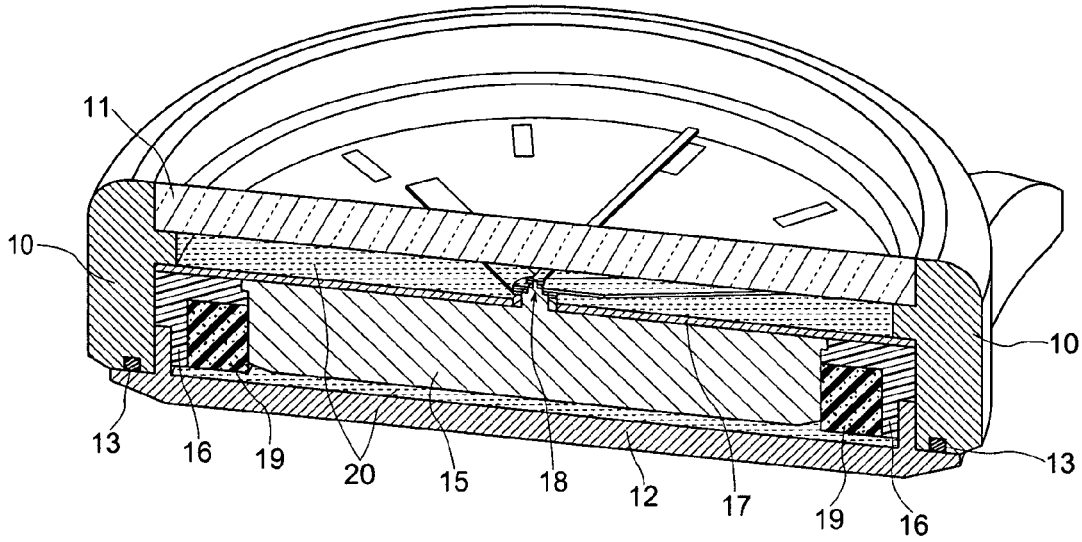
FIG. 2 is a sectional view of the watch of FIG. 1, where the watch has been filled with dielectric liquid and is equilibrated at its lowest operating temperature.
Figure 3:
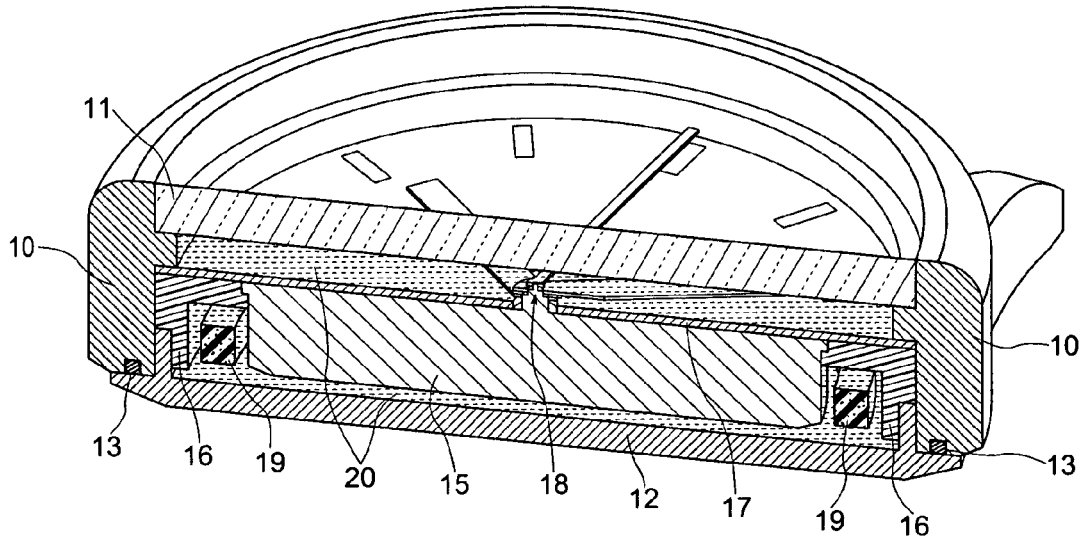
FIG. 3 is a sectional view of the watch of FIG. 2, where the watch has been heated to its highest operating temperature.

One embodiment of the thermal expansion compensator for a liquid-filled watch is shown in FIGS. 1, 2, and 3. FIG. 1 shows an exploded view of the watch prior to filling with liquid. A watch case 10 is joined to a transparent crystal 11 by a suitable gasket of conventional design (not shown). A case back 12 is joined to the bottom of the case 10 and is sealed by an o-ring 13 or similar hermetic seal. The case back 12 is joined to the case 10 by a conventional fastening method such as screw threads (not shown). A crown 14 is provided for setting time. The case 10 encloses an electronic movement module 15 that is surrounded by a movement spacer ring 16. The ring 16 centers the movement module 15 in a position adjacent to a dial 17. The movement module 15 drives the watch hands 18. A piece of closed-cell foam 19 is located in an annular region around the movement module 15.

FIG. 2 shows a sectional view of the watch of FIG. 1 after it is entirely filled with a clear dielectric liquid 20 and is equilibrated at its lowest operating temperature, for example −10° C. The closed-cell foam 19 is not compressed. The watch can be filled by various conventional methods. In this embodiment, the watch was submerged in the liquid without the case back 12. Vacuum was applied to remove residual air, then the case back was installed while still submerged in the liquid.

FIG. 3 shows a sectional view of the watch of FIG. 2 after it has been heated to its highest operating temperature, for example 60° C. The closed-cell foam 19 is compressed by thermal expansion of the liquid 20.

In the first embodiment, the case 10 and case back 12 are made of 316L stainless steel. The crystal 11 is made of sapphire. Over the operating range of −10 to 60° C., the internal volume of the watch changes by less than 0.5% due to thermal expansion. The liquid 20 is a perfluorinated fluid. It is a mixture of perfluoro n-alkyl morpholines and is sold as Fluorinert™ FC-770 Electronic Liquid by 3M of St. Paul, Minn. Over the operating range of −10 to 60° C., its volume changes by 10% due to thermal expansion.

The closed-cell foam 19 is composed of FKM fluoroelastomer. Even when cut, the foam will not allow the passage of air or fluid between cells. FKM fluoroelastomer has excellent resistance to compression set and very low permeability to liquids and gases. These properties ensure long term durability over the course of cycling between compression and decompression. The sales specification of the foam indicates a compressive strength in the range of 4 to 7 psi at 25% deflection. This is considered an extra soft foam, and limits pressure buildup inside the watch interior. In this embodiment, 3.0 $cm^3$ of liquid 20 was charged into the watch and the volume of the closed-cell foam 19 was 0.6 $cm^3$. Over the range of −10 to 60° C., the liquid 20 expands by 0.3 $cm^3$. This in turn compresses the closed-cell foam 19 by 0.3 $cm^3$, equivalent to 50% deflection of the foam.

The second embodiment is similar to the first embodiment shown in FIGS. 1, 2 and 3 except for a different selection of liquid 20 and of closed-cell foam 19. The liquid 20 is a silicone fluid. It is polydimethylsiloxane, sold as Xiameter™ PMX-200 Silicone Fluid 1.5 cSt by Dow Corning of Midland, Mich. Over the operating range of −10 to 60° C., its volume changes by 9% due to thermal expansion. The closed-cell foam 19 is a blend of neoprene/PVC/nitrile. The sales specification of the foam indicates a compressive strength in the range of 2 to 5 psi at 25% deflection. In this embodiment, 2.7 $cm^3$ of liquid 20 was charged into the watch and the volume of the closed-cell foam 19 was 0.9 $cm^3$. Over the range of −10 to 60° C., the liquid 20 expands by 0.25 $cm^3$. This in turn compresses the closed-cell foam 19 by 0.25 $cm^3$, equivalent to 30% deflection of the foam.

Accordingly, the reader will see that the closed-cell foam of the various embodiments can be used as a low-cost compensator for thermal expansion of the dielectric liquid. It enables production of liquid-filled watches without the need for complex and expensive case designs. It also avoids the need for a free-floating air bubble in the liquid. The closed-cell foam can be easily cut into various shapes that conform to interior spaces of the case. Also, closed-cell foam is robust for long term use as it does not rely on a single sealing element to retain proper function. An additional advantage is that closed-cell foam can be used to quickly retrofit a watch for liquid filling even if the watch was not originally designed to contain liquid.

While the above description contains many specificities, these should not be construed as limitations on the scope, but rather as exemplifications of various embodiments thereof. Many other variations are possible. For example, the movement module 15 may be a simple quartz model driven by a lithium battery, or it may contain additional complications such as a moon phase indicator or a date wheel. Instead of running on a battery, it may be powered by solar cells in combination with a capacitor. Or it may have a digital display instead of analog hands. The closed-cell foam 19 may be in multiple pieces, and can be located in any free space inside the watch case. It may be partially compressed even at the lowest operating temperature. The case 10 may be made of alternative materials such as ceramic or plastic. The crystal 11 can be constructed of sapphire, mineral glass, acrylic, or any other suitable transparent material. Various gasket designs can be used to seal the watch case 10, including the mating areas around the crown 14, crystal 11, and case back 12.

Accordingly, the scope should be determined not by the embodiments illustrated, but by the appended claims and their legal equivalents.

What is claimed is:

1. A watch, comprising:

(a) a case defining a main inner space of a substantially invariable volume which is sealed from the outer atmosphere, (b) an electronic movement module inside said case, (c) a piece of closed-cell foam inside said case, and (d) a dielectric liquid that substantially fills the interior spaces of said case, whereby said closed-cell foam will compensate for thermal expansion of said dielectric liquid by compression to a smaller volume.

2. The watch of claim 1 wherein said dielectric liquid is composed of a perfluorinated fluid.

3. The watch of claim 1 wherein said dielectric liquid is composed of a silicone fluid.

4. The watch of claim 1 wherein said closed-cell foam is composed of FKM fluoroelastomer.

5. The watch of claim 1 wherein said closed-cell foam has a compressive strength of less than 7 psi at 25% deflection.

6. The watch of claim 1 wherein said closed-cell foam is located in the annular region surrounding the electronic movement module.

* * * * *